US005711686A

United States Patent [19]

O'Sullivan et al.

[11] Patent Number: 5,711,686

[45] Date of Patent: Jan. 27, 1998

[54] SYSTEM FOR TERMINATING THE SHIELD OF A HIGH SPEED CABLE

[75] Inventors: Michael O'Sullivan, Willowbrook; David L. Brunker, Naperville; Walter Graham McFarlane, Elgin; Joseph W. Nelligan, Jr., LaGrange Park, all of Ill.

[73] Assignee: Molex Incorporated, Lisle, Ill.

[21] Appl. No.: 609,579

[22] Filed: Mar. 1, 1996

[51] Int. Cl.[6] ..... H01R 9/03

[52] U.S. Cl. ..... 439/610; 29/879

[58] Field of Search ..... 439/607, 608, 439/609, 610, 108; 29/879

[56] References Cited

U.S. PATENT DOCUMENTS

| | | | |
|---|---|---|---|
| 4,615,578 | 10/1986 | Stadler et al. | 439/607 |
| 5,190,473 | 3/1993 | Mroczkowski et al. | 439/580 |
| 5,197,893 | 3/1993 | Morlion et al. | 439/101 |
| 5,304,069 | 4/1994 | Brunker et al. | 439/108 |

*Primary Examiner*—Khiem Nguyen
*Assistant Examiner*—Yong Ki Kim
*Attorney, Agent, or Firm*—Charles S. Cohen

[57] ABSTRACT

A system is disclosed for terminating the shield a high speed cable having an outer jacket, an inner metallic shield with a portion of the outer jacket removed to expose a portion of the metallic shield, and an inner dielectric inside the metallic shield. The system includes a conductive two-part terminating member having a shield management part and a shield terminating part. The shield management part is adapted for allowing separation of the metallic shield from the inner dielectric and soldering of the shield to the shield management part, while protecting the inner dielectric from the heat of soldering. The shield terminating part is adapted for grounding the metallic shield and includes a receptacle for receiving the shield management part in conductive engagement therewith.

33 Claims, 5 Drawing Sheets

SYSTEM FOR TERMINATING THE SHIELD OF A HIGH SPEED CABLE

FIELD OF THE INVENTION

This invention generally relates to the art of electrical connectors and, particularly, to a system for terminating the metallic shield of a high speed cable, such as the metallic braid of the cable.

BACKGROUND OF THE INVENTION

A typical high speed cable includes a center conductor or core surrounded by a tube-like inner dielectric. A shield is disposed outside the inner dielectric for shielding and/or grounding the cable. The shield typically is a tubular metallic braid. However, one or more longitudinal conductive wires have also been used and are commonly called "drain wires." An insulating jacket surrounds the composite cable outside the shield.

Various types of connectors are used to terminate high speed cables. The connectors typically have contacts which are terminated to the center conductor or core of the cable. The connectors also have one form or another of a terminating member for terminating the metallic shield of the high speed cable, usually for grounding purposes. A typical system in such connectors terminates the metallic shield to the terminating member by soldering. Other systems use crimping procedures to crimp at least a portion of the terminating member securely to the metallic braid for commoning purposes.

With the ever-increasing miniaturization of the electronics in various industries, such as in the computer and telecommunications industries, along with the accompanying miniaturization of electrical connectors, considerable problems have been encountered in terminating miniature high speed cables, particularly in terminating the metallic shield of the cable. For instance, the outside diameter of a small coaxial cable may be on the order of 0.090 inch. The outside diameter of the inner dielectric surrounding the conductor/core may be on the order of 0.051 inch, and the diameter of the center conductor/core may be on the order 0.012 inch. Coaxial cables having even smaller dimensional parameters have been used.

The problems in terminating such very small coaxial cables often revolve around terminating the metallic shield of the cable. For instance, if soldering methods are used, applying heat (necessary for soldering) in direct proximity to the metallic shield can cause heat damage to the underlying inner dielectric and, in fact, substantially disintegrate or degrade the inner dielectric. If conventional crimp-type terminations are used, typical crimping forces often will crush or deform the inner dielectric surrounding the center conductor/core of the cable.

The above problems are further complicated when the metallic shield of the high speed cable is not terminated to a cylindrical terminating member, but the shield is terminated to a flat terminating member or contact. For instance, it is known to terminate the tubular metallic shield or braid of a coaxial cable to a flat ground circuit pad on a printed circuit board. This is accomplished most often by simply gathering the tubular metallic braid of the coaxial cable into a twisted strand or "pigtail" which, in turn, is soldered to the flat ground pad on the circuit board.

Another example of terminating the metallic shield or braid of a coaxial cable to a flat ground member is shown in U.S. Pat. No. 5,304,069, dated Apr. 19, 1994 and assigned to the assignee of the present invention. In that patent, the metallic braids of a plurality of coaxial cables are terminated to a ground plate of a high speed signal transmission terminal module. The conductors/cores of the coaxial cables are terminated to signal terminals of the module.

In terminating the tubular metallic shields or braids of high speed cables to flat ground contact pads as in a printed circuit board, or to a planar ground plate as in the above-referenced U.S. patent, or to any other flat or non-tubular terminating member, various design considerations should be considered as has been found with the present invention. It should be understood that there is a transition zone created where the center conductor/core of the high speed cable goes from a "controlled environment" wherein the conductor/core is completely surrounded by the tubular metallic shield or braid, to an "uncontrolled environment" where the braid is spread away from the conductor/core for termination to the non-tubular terminating member. It is desirable that this transition zone be held to as small an area as possible and as short a length (i.e., longitudinally of the cable) as possible. Preferably, the metallic shield or braid should be terminated over an area (or at least at two points) approximately 180° apart in relation to the center conductor/core of the cable. Preferably, the flat terminating member should overlap or at least extend to the point where the metallic shield or braid is separated from its tubular configuration surrounding the conductor/core of the cable. Still further, it is desirable that the metallic shield or braid of any given high speed cable be terminated on the same side of the flat terminating member as the center conductor/core of the cable.

The present invention is directed to solving the above-identified problems and satisfying as many of the above-identified design parameters as possible in an improved system for terminating the metallic shield of a high speed cable to a terminating member, such as a ground plate.

SUMMARY OF THE INVENTION

An object, therefore, of the invention is to provide a new and improved method of terminating the metallic shield of a high speed cable, as well as a system for terminating the shield of the cable.

In the exemplary embodiment of the invention, a system is disclosed for terminating the shield of a high speed cable which has an outer jacket, an inner metallic shield with a portion of the outer jacket removed to expose a portion of the metallic shield, and an inner dielectric inside the metallic shield. The system includes a conductive two-part terminating member including a shield management part and a shield terminating part. The shield management part is adapted for allowing separation of the metallic shield from the inner dielectric and soldering the shield to the shield management part, while protecting the dielectric from the heat of soldering. The shield terminating part is adapted for grounding the metallic shield and includes receptacle means for receiving the shield management part in conductive engagement therewith.

As disclosed herein, the shield terminating part comprises a ground plate having a generally planar blade portion with a pair of positioning arms at opposite edges of the blade portion defining a generally U-shaped receptacle means for receiving the shield management part. The shield management part also is generally U-shaped and is sized for nesting within the receptacle means defined by the blade portion and the positioning arms of the ground plate.

Specifically, the U-shaped shield management part includes a pair of leg portions joined by a bight portion. The shield management part is nested in the receptacle means with the leg portions of the shield management part juxtaposed inside the positioning arms of the ground plate. In one embodiment of the invention, the bight portion of the U-shaped shield management part is juxtaposed against the blade portion of the ground plate. In another embodiment of the invention, the bight portion of the U-shaped shield management part is spaced from the blade portion of the ground plate.

Lastly, the metallic shield is soldered to the outside of the U-shaped shield management part with the inner dielectric of the cable disposed on the inside thereof. Preferably, the shield is soldered over an area of approximately 180° about a center-line of the respective high speed cable.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
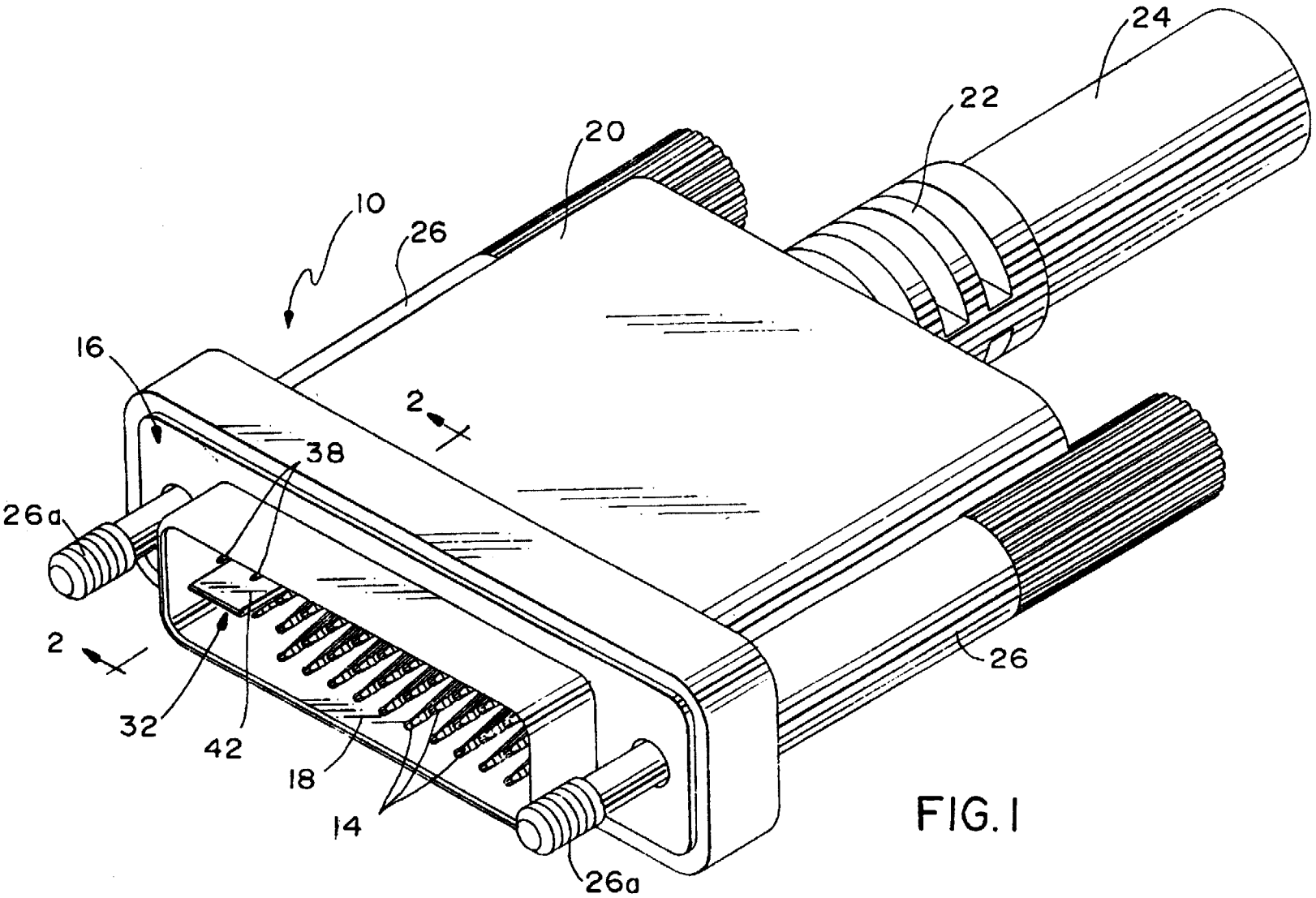
FIG. 1 is a perspective view of an electrical connector of a type in which the invention is applicable.
Figure 2:
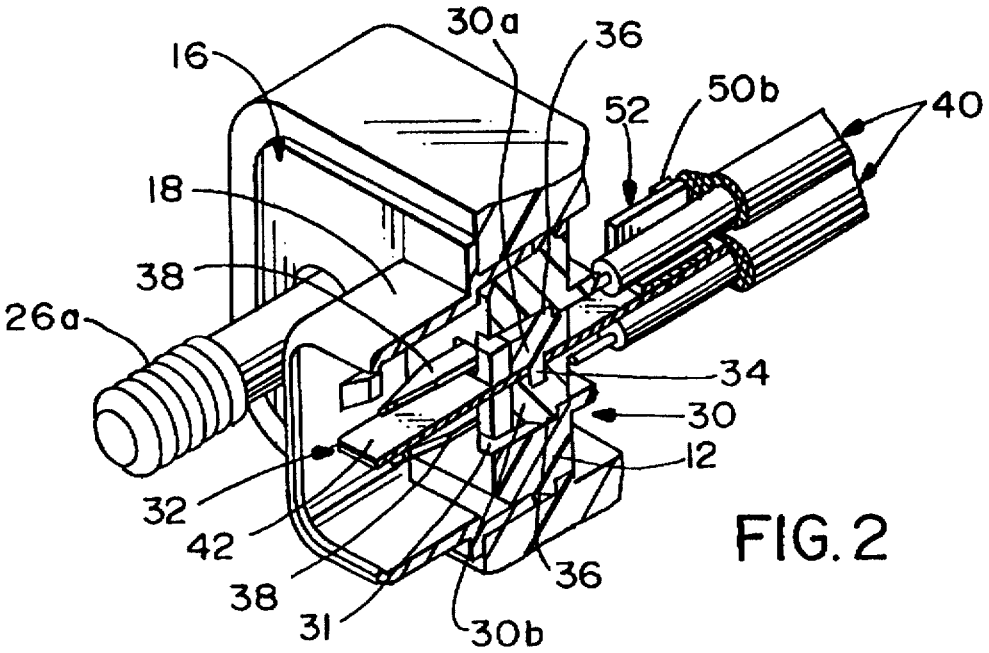
FIG. 2 is a fragmented vertical section taken generally along line 2—2 of FIG. 1.

Referring to the drawings in greater detail, and first to FIGS. 1 and 2, the invention is embodied in a shielded electrical connector, generally designated 10, which is a hybrid electrical connector for terminating both the conductors of slower data transmission lines and the conductors of high speed or high frequency transmission lines. In particular, electrical connector 10 includes a dielectric housing 12 (FIG. 2) mounting a plurality of data transmission terminals 14 (FIG. 1). A conductive shield, generally designated 16, substantially surrounds dielectric housing 12 and has a shroud portion 18 projecting forwardly about the mating ends of data transmission terminals 14. A two piece backshell (not shown) substantially inconformance with that shown in U.S. Pat. No. 5,358,428, dated Oct. 25, 1994 projects rearwardly of housing 12 and shield 16. An overmolded boot 20 includes an integral cable strain-relief that is in engagement with a composite electrical cable 24 which includes both the data transmission lines and the high speed or high frequency transmission lines. A pair of thumb screws 26 project through the overmolded boot and include externally threaded forward distal ends **26*a*** for securing the connector to a complementary mating connector, panel or other structure.

As seen best in FIG. 2, a high speed signal transmission terminal module, generally designated 30, is inserted into a passage 31 in dielectric housing 12 from the rear thereof. The terminal module includes a pair of identical terminal blocks **30*a* and 30*b* which clamp a ground plate, generally designated 32, therebetween. Each terminal block includes a post 34 and a recess. The post from each terminal block extends from each terminal block through a hole or slot 44 (FIG. 3) in the ground plate and into a recess in the other terminal block to secure terminal blocks 30*a* and 30*b* to ground plate 32 as a subassembly. Once this subassembly is inserted into passage 31 in housing 12 as shown in FIG. 2, the terminal blocks are effective to clamp the ground plate therebetween. The terminal module is held within the dielectric housing by ramped latches 36** on each terminal block.

Each terminal block **30*a* and 30*b* is overmolded about at least one high speed signal terminal 38. The contact ends of a pair of the terminals 38, along with the forward end of ground plate 32, are shown projecting forwardly of the connector in FIG. 1, within the surrounding shroud portion 18 of shield 16. The rear ends 38*a* of terminals 38 (FIG. 10) are terminated to the center conductor/cores 58 of a plurality of coaxial cables, generally designated 40 in FIG. 2. The invention is particularly directed to the manner of termination of the metallic shields 62 of the coaxial cables to ground plate 32**, as described below.

Figure 3:
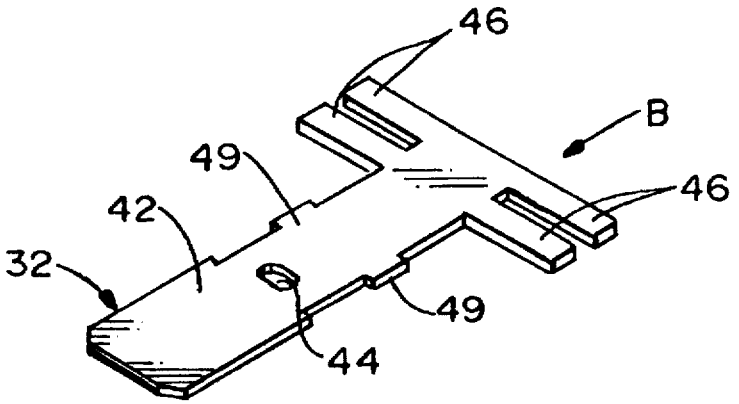
FIG. 3 is a perspective view of a stamped metal blank from which the terminating member or ground plate is formed.

More particularly, FIG. 3 shows a blank, generally designated "B," stamped from conductive sheet metal material and from which ground plate 32 is formed. Blank "B" is generally T-shaped and includes a leg portion 42 which will form a blade portion for ground plate 32. The blade portion includes an aperture 44 through which posts 34 (FIG. 2) of terminal blocks **30*a* and 30*b* extend. A pair of wings or arms 46 project outwardly at one end of leg 42 generally at each opposite edge thereof. These wings will form the gripping arms of the ground plate, as will be seen hereinafter. Lastly, barbs or teeth 49 are stamped at the opposite edges of blade portion 42 to facilitate holding subassembly of the ground plate and terminal blocks 30*a* and 30*b*** within the housing.

Figure 4:
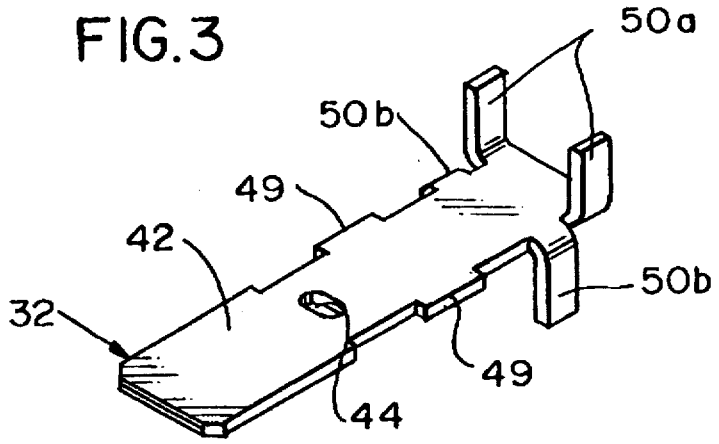
FIG. 4 is a perspective view of the ground plate with the positioning arms partially formed to receive the coaxial cables.

FIG. 4 shows the stamped blank "B" of FIG. 3 with wings 46 having been bent inwardly to form a pair of upper positioning arms **50*a* and a pair of lower positioning arms 50*b*. In essence, ground plate 42 is provided with a pair of opposed positioning arms at opposite edges of the plate, as well as providing a pair of the opposed positioning arms on each opposite side of the plate. One pair 50*a* is located at the extreme rear distal end of blade portion 42**, and the other pair 50*b* is located slightly spaced longitudinally forward of the first pair. With this structure, the ground plate can terminate from one to four coaxial cables depending on the specifications of the connector. If desired, the arms 50*a* and 50*b* could be spaced inwardly from the end of ground plate 32 so that the ground plate extends along cable 40 at the point where the metallic shield 56 of the cable is separated from the inner dielectric layer 54.

At this point, it should be understood that the system of the invention contemplates the use of a conductive two-part terminating member including a shield terminating part provided by ground plate 32. The second part is a shield management part in the form of a generally U-shaped conductive termination clip, generally designated 52 in FIG. 5. The U-shaped termination clip includes a pair of leg portions 54 joined by a bight portion 56. Each leg 54 is preferably slightly longer than the diameter of the inner dielectric 60 of cable 40 to be terminated. In addition, bight portion 56 is preferably slightly wider than twice the diameter of the inner dielectric 60 in order to permit two cables 40 to be positioned within clip 52. The U-shaped clip is sized for nesting within a receptacle defined by blade portion 42 and each pair of positioning arms 50*a* or 50*b* of ground plate 32, as will be seen hereinafter.

Figure 5:
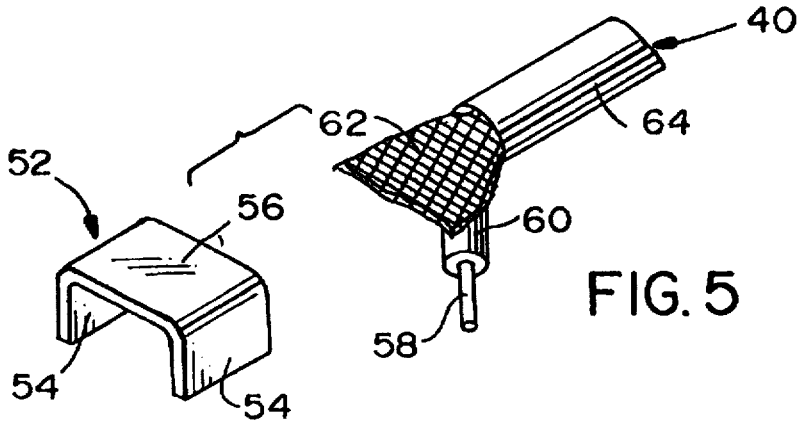
FIG. 5 is a perspective view of the shield management part of the two-part terminating member, along with a coaxial cable which has been prepared for soldering to the shield management part.

FIG. 5 also shows one of the coaxial cables, generally designated 40, prepared for use with the system of the invention. It should be understood that each coaxial cable 40 is of a conventional construction in that each cable includes a center conductor or core 58 surrounded by a tube-like inner dielectric insulator 60. A metallic shield in the form of a tubular metallic braid 62 surrounds dielectric 60. An insulating jacket 64, as of plastic or the like, surrounds metallic braid 62 to form the overall composite coaxial cable 40.

As seen in FIG. 5, coaxial cable 40 has been prepared such that conductor/core 58 has been stripped to expose a given length thereof which will be soldered, welded or otherwise secured to the inner end of one of the high speed signal transmission terminals 38 shown in FIG. 2. The outer insulating jacket 64 of the cable has been cut-back to expose a given length of the metallic shield 62. The inner dielectric insulator 60 and the conductor/core 58 have been bent at approximately a 90° angle to the axis of the coaxial cable, and metallic shield or braid 62 has been spread or flared outwardly away from the inner dielectric and generally flattened.

Figure 6:
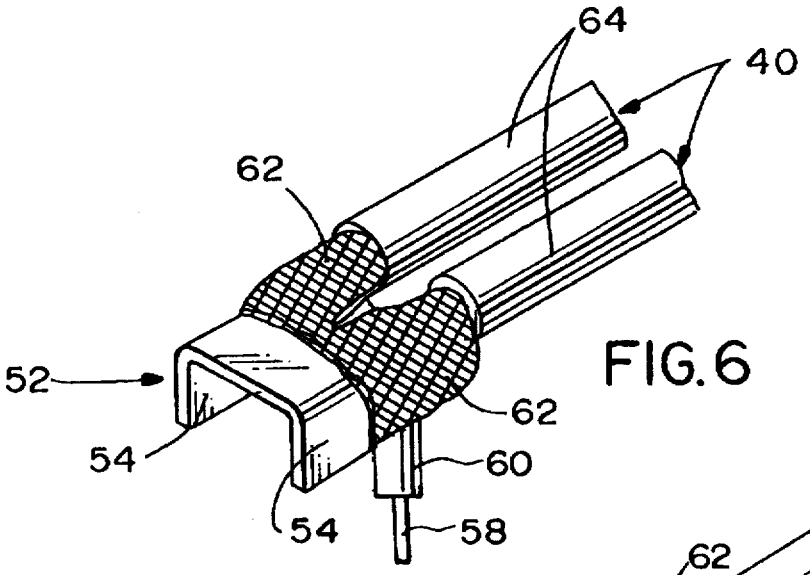
FIG. 6 is a perspective view of a pair of coaxial cables having their metallic shields soldered to the outside of the shield management part.

FIG. 6 shows a pair of coaxial cables 40 which have been prepared as described above in relation to FIG. 5, and with the flared metallic shields 62 of the cable soldered to the outside of U-shaped termination clip 52. It can be seen that the metallic braid of each cable is soldered to the termination clip over an area extending approximately from the center of bight portion 56 of the clip to the edge of a respective one of the leg portions 54 of the clip. Therefore, the metallic shield of each cable extends circumferentially approximately 180° about the axis of the respective coaxial cable. During the soldering process, termination clip 52 not only provides a means for managing the metallic shields, but the clip provides for thermal relief and protection of inner dielectric insulators 60 of the cables to prevent the insulators from being damaged by the heat generated from the soldering process.

Figure 7:
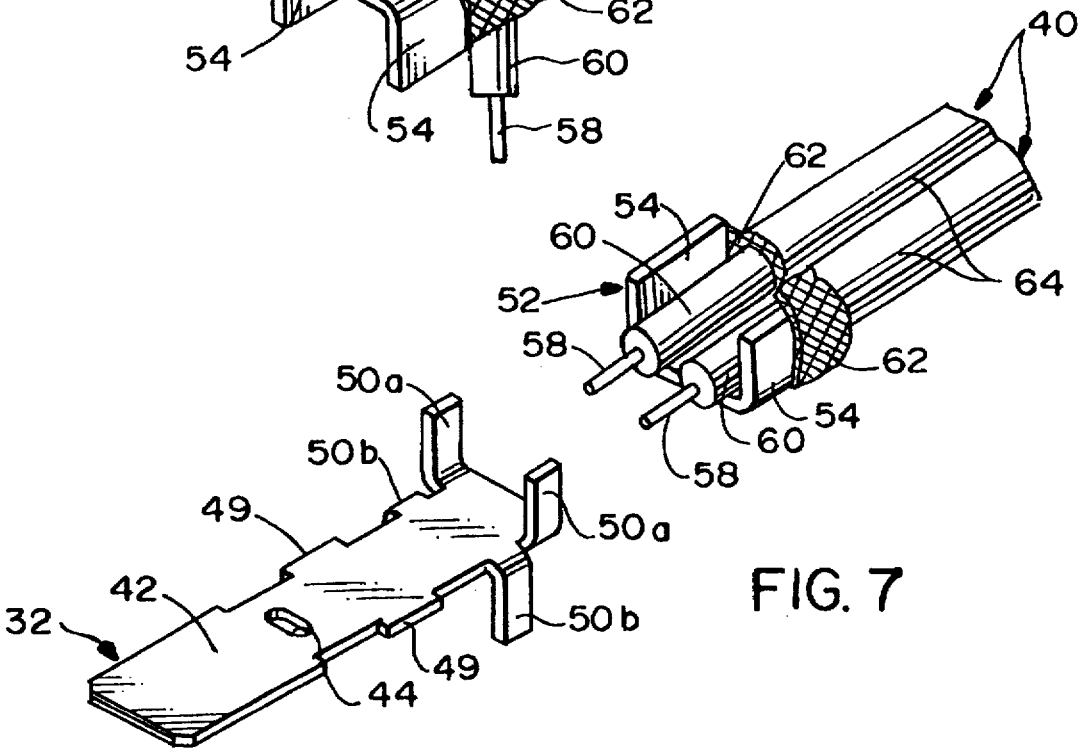
FIG. 7 is a view of the pair of coaxial cables and the shield management part of FIG. 6 inverted and shown in conjunction with the ground plate which forms the shield terminating part of the two-part terminating member.

FIG. 7 shows the subassembly of FIG. 6, with inner dielectric insulators 60 and center conductors/cores 58 of the two coaxial cables having been bent back to their collinear relationships relative to the axes of the cables. The dielectric insulators are now positioned inside leg portions 54 of termination clip 52, with the metallic shields of the cables having previously been soldered to the outside of the clip. This subassembly is shown about to be nested within upper positioning arms 50*a* of ground plate 32. With the inner dielectric insulators and conductors/cores of the cables having been straightened out as shown in FIG. 7, termination clip 52 may be simply snap-fit between positioning arms 50*a* of ground plate 32. Projections and recesses could be formed on the outer surface of clip 52 and the inner surface of arms 50*a* in order to better retain the clip and improve electrical performance.

Figure 8:
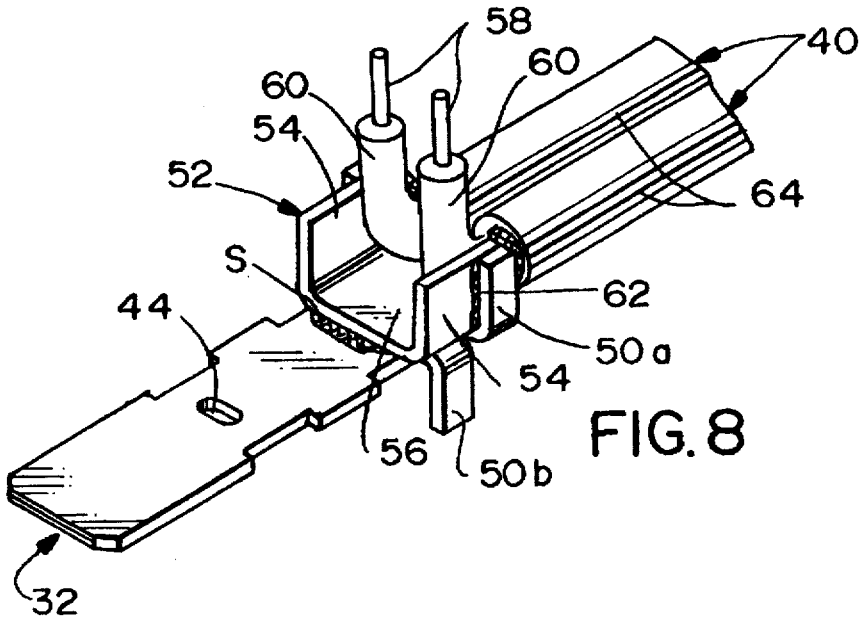
FIG. 8 shows the two parts of the terminating member in assembled condition.

In the alternative, FIG. 8 shows termination clip 52 and the terminated coaxial cables 40 in position between positioning arms 52*a* of ground plate 32, but with inner dielectric insulators 60 still bent 90° to the axes of the cables. With this configuration, termination clip 52 can be soldered, as at "S," to blade portion 42 of ground plate 32, without risking the possibility of damaging the inner dielectric from the heat of the soldering process. After the clip is soldered to the ground plate, the inner dielectric and the center conductor/core of each cables can be straightened back to their linear positions as shown in FIG. 7 so that the conductors/cores can be terminated to the terminals of the terminal module, as described above.

Figure 9:
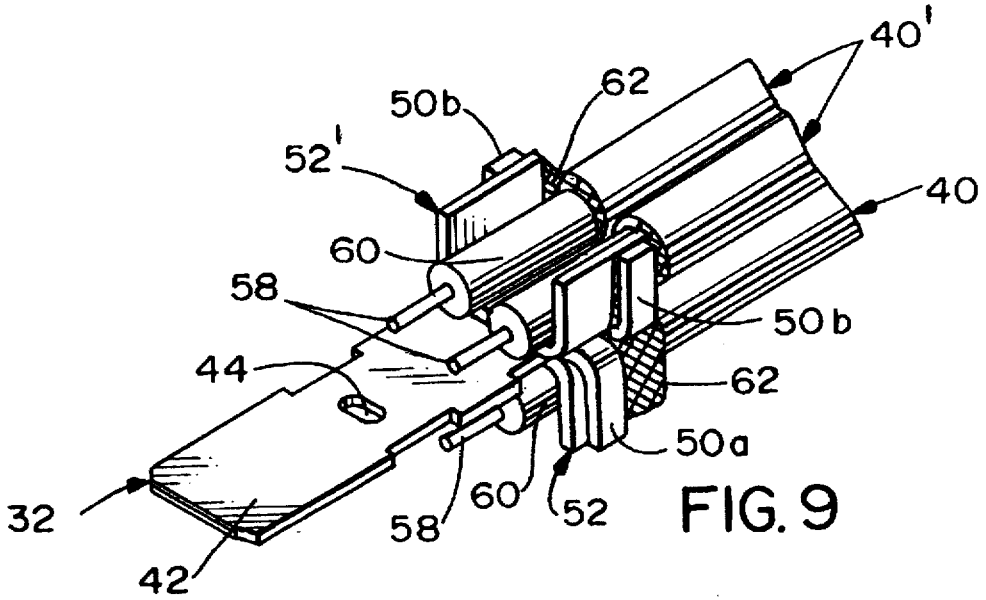
FIG. 9 shows the subassembly of FIG. 8 turned upside-down, and with a second pair of coaxial cables and a second shield management part secured to the ground plate.

FIG. 9 shows the subassembly of FIGS. 7 and 8 turned upside-down and with a second termination clip 52' nested within positioning arms 50*b*, and with the shields of a second pair of coaxial cables 40' having been terminated to the termination clip. Therefore, four coaxial cables may be terminated with the terminating member of the invention comprising two shield management parts or termination clips 52 and 52' and the shield termination part or ground plate 32. As stated above, one to four coaxial cables can be terminated by the system of the invention, depending on the particular specifications of connector 10. For instance, in computer applications, three cables may be used to carry the red, green and blue chroma signals for a monitor. A fourth cable might be used for flat screen monitors for carrying the pixel clock timing signals.

Figure 10:
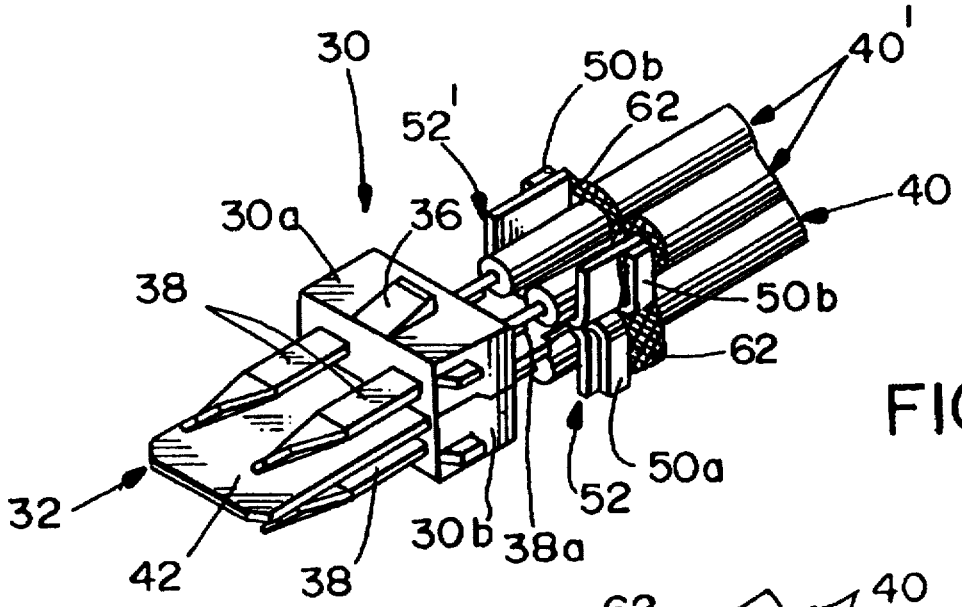
FIG. 10 is a perspective view of the terminal module of the connector, including the subassembly of FIG. 9.

Once the subassembly of FIG. 9 is fabricated, including the soldering procedures, this subassembly is assembled to terminal blocks 30*a* and 30*b* and high speed signal transmission terminals 38 to form terminal module 30 as shown in FIG. 10 and described above in relation to FIG. 2. Center conductors/cores 52 of the coaxial cables are connected, as by soldering to the inner ends 38*a* of terminals 38, with terminal blocks 30*a* and 30*b* clamping blade portion 42 of ground plate 32 therebetween, as shown in FIG. 2 and described above. The blade portion 42 extends rearwardly beyond, or at least overlaps, the point where the metallic shields 62 discontinue their cylindrical configurations inside jackets 64 and start to become spread out over termination clip 52. The terminal module then is mounted within dielectric housing 12 as shown in FIG. 2.

Figure 11:
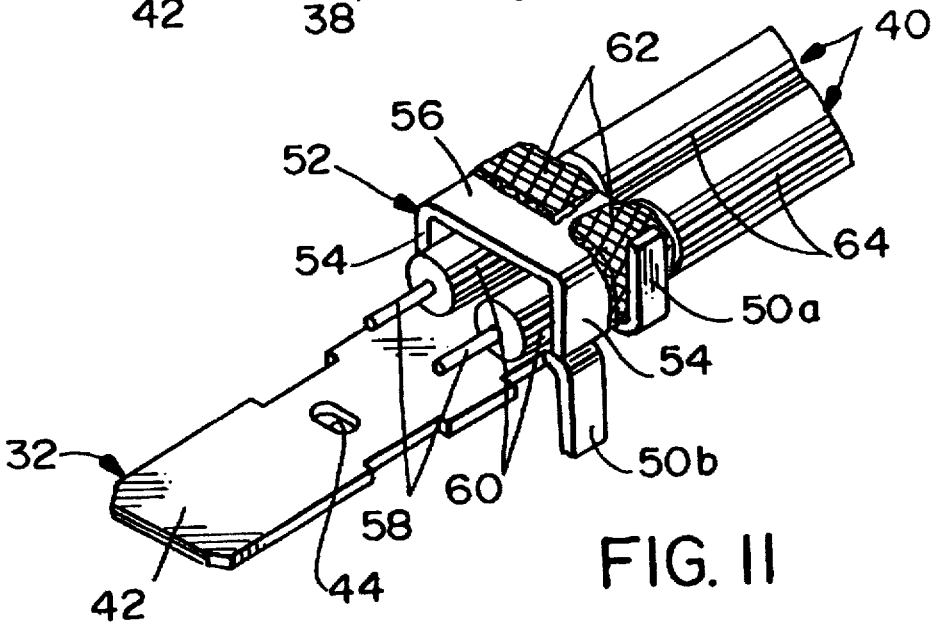
FIG. 11 is a view similar to that of FIG. 8, but showing an alternative embodiment of the invention wherein the shield management part is inverted in comparison to its position in FIG. 8.

Termination clip 52 is shown in FIGS. 2 and 7–10 nested within positioning arms 50*a* or 50*b* of ground plate 32, with leg portions 54 of each termination clip juxtaposed inside the positioning arms of the ground plate, and with bight portion 56 of each termination clip juxtaposed against blade portion 42 of the ground plate. Alternatively, FIG. 11 shows an embodiment wherein the termination clip 52 is inverted and nested within the positioning arms of ground plate 32. In other words, leg portions 54 of the termination clip still are juxtaposed inside positioning arms 50*a* or 50*b* of the ground plate. However, it can be seen in FIG. 11 that the bight portion 56 which joins leg portions 54 is spaced above blade portion 42 of ground plate 32 with inner dielectric 60 and center conductor 58 therebetween. This maximizes 360° shielding of the signals as is typical in coaxial cables. In other words, the termination clip provides an extended EMI shield within backshell 20 of connector 10.

The concepts of the invention have been shown and described herein in conjunction with terminating the metallic shield of the coaxial cable to a two-part terminating member in the form of termination clip 52 and ground plate 42. However, it should be understood that the concepts of the invention may be equally applicable for terminating the metallic shield to other types of terminating members, such as electrical terminals themselves.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A termination assembly comprising:

a pair of cables, each having an inner conductor, an inner dielectric surrounding at least a portion of said inner conductor, a metallic shield surrounding at least a portion of said inner dielectric and an outer insulating jacket surrounding at least a portion of said metallic shield, a portion of said outer jacket of each of said cables being removed to expose an exposed portion of said metallic shield;

a terminal to which said metallic shields are to be terminated, said terminal being at least partially disposed in a dielectric housing of an electrical connector and having a ground portion;

a conductive shield management member separating said metallic shield from said inner dielectric of each of said cables when said exposed portions of said metallic shields are being bonded to said shield management member such that said shield management member shields said inner dielectric of each of said cables from heat generated when said metallic shields are being bonded to said shield management member; and a shield terminating member on said ground portion, said shield terminating member forming a receptacle for receiving said shield management member in conductive engagement therewith.

2. The termination assembly of claim 1 wherein said ground portion includes a ground plate having a generally planar blade portion and wherein said shield terminating member includes a pair of positioning arms at opposite edges of said blade portion defining said receptacle for receiving said shield management member.

3. The termination assembly of claim 2 wherein said pair of positioning arms and said blade portion define a generally U-shaped receptacle and said shield management member is generally U-shaped and sized for nesting within said receptacle.

4. The termination assembly of claim 3 wherein said U-shaped shield management member includes a pair of leg portions joined by a bight portion, the shield management member being nested in said receptacle with said leg portions of said shield management member juxtaposed inside said positioning arms of said ground plate and said bight portion of said shield management member being juxtaposed against said blade portion of said ground plate.

5. The termination assembly of claim 4 wherein said exposed portions of said metallic shields are bonded to an outside of said U-shaped shield management member.

6. The termination assembly of claim 5 wherein said metallic shields are bonded to said U-shaped shield management member such that said metallic shields extend circumferentially about at least a half of the circumference of each of said cables.

7. The termination assembly of claim 4 wherein the inner dielectric of each of said cables with said inner conductor therein is disposed within said leg portions and said bight portion of said U-shaped shield management member.

8. The termination assembly of claim 3 wherein said U-shaped shield management member includes a pair of leg portions joined by a bight portion, said shield management member being nested in said receptacle with said leg portions juxtaposed inside said positioning arms of said ground plate and said bight portion being spaced from said blade portion of said ground plate.

9. The termination assembly of claim 8 wherein said exposed portions of said metallic shields are bonded to an outside of said U-shaped shield management member.

10. The termination assembly of claim 9 wherein said metallic shields are bonded to said U-shaped shield management member such that said metallic shields extend circumferentially about at least a half of the circumference of said cable.

11. The termination assembly of claim 1 wherein said shield management member is bonded to said shield terminating member.

12. The termination assembly of claim 1 including at least one additional cable to be terminated to said ground portion, said additional cable including an additional inner conductor, an additional inner dielectric surrounding at least a portion of said additional inner conductor, an additional metallic shield surrounding at least a portion of said additional inner dielectric and an additional outer insulating jacket surrounding at least a portion of said additional metallic shield, a portion of said additional outer jacket being removed to expose an additional exposed portion of said additional metallic shield and said termination assembly further including an additional conductive shield management member separating said additional metallic shield from said additional inner dielectric of said additional cable when said exposed portion of said additional metallic shield is being bonded to said additional shield management member such that said additional shield management member shields said additional inner dielectric from heat generated when said additional metallic shield is being bonded to said additional shield management member and an additional shield terminating member on said ground portion, said additional shield terminating member having a pair of additional positioning arms at opposite edges of said ground portion defining an additional receptacle on a side of said ground portion opposite the side on which said receptacle is formed for receiving said additional shield management member in conductive engagement therewith.

13. The termination assembly of claim 12 wherein said ground portion includes an elongated ground plate and said positioning arms and said additional positioning arms are spaced longitudinally along said ground plate with respect to each other.

14. An electrical connector for terminating to a pair of cables, each having an inner conductor, an inner dielectric surrounding at least a portion of said inner conductor, a metallic shield surrounding at least a portion of said inner dielectric and an outer insulating jacket surrounding at least a portion of said metallic shield, a portion of said outer jacket of each of said cables being removed to expose an exposed portion of said metallic shield, said electrical connector comprising:

a dielectric housing having a mating face, a termination face and a plurality of terminal receiving passages between said mating face and said termination face;

a plurality of terminals extending through at least a portion of said terminal receiving passages;

a ground portion at least partially disposed in said housing relative to said terminals and having a generally planar blade portion;

a shield management member including a pair of leg portions joined by a bight portion defining a protective cavity, said metallic shield of each of said cables adapted to be bonded to said shield management member such that said shield management member separates said metallic shield from said inner dielectric of each of said cables so as to protect said inner dielectric within said protective cavity of said shield management member; and a shield terminating member formed from said ground portion, said shield terminating member having a pair of positioning arms at opposite edges of said blade portion defining a receptacle for receiving said shield management member.

15. The electrical connector of claim 14 wherein said shield management member is nested in said receptacle with said leg portions of said shield management member juxtaposed inside said positioning arms of said shield terminating member and said bight portion of said shield management member being juxtaposed against said blade portion of said shield terminating member.

16. The electrical connector of claim 15 wherein said metallic shield of each of said cables is bonded to the outside of said shield management member so that said metallic shields are bonded to said shield management member about at least a half of the circumference of each of said cables.

17. The electrical connector of claim 15 wherein said shield management member is nested in said receptacle with said leg portions of said shield management member juxtaposed inside said positioning arms of said shield terminating member and said bight portion being spaced from said blade portion of said shield terminating member.

18. The electrical connector of claim 17 wherein said metallic shield of each of said cables is bonded to said shield management member so that said metallic shields are bonded to said shield management member about at least a half of the circumference of each of said cables.

19. The electrical connector of claim 15 wherein at least one additional cable is to be terminated to said ground portion, said additional cable having an additional inner conductor, an additional inner dielectric surrounding at least a portion of said additional inner conductor, an additional metallic shield surrounding at least a portion of said additional inner dielectric and an additional outer insulating jacket surrounding at least a portion of said additional metallic shield, a portion of said additional outer jacket being removed to expose an additional exposed portion of said additional metallic shield and wherein said electrical connector includes an additional conductive shield management member separating said additional metallic shield from said additional inner dielectric of said additional cable when said exposed portion of said additional metallic shield is being bonded to said additional shield management member such that said additional shield management member shields said additional inner dielectric from heat generated when said additional metallic shield is being bonded to said additional shield management member and an additional shield terminating member on said ground portion, said additional shield terminating member having a pair of additional positioning arms at opposite edges of said blade portion defining an additional receptacle on a side of said blade portion opposite the side on which said receptacle is formed for receiving said additional shield management member in conductive engagement therewith.

20. The electrical connector of claim 19 wherein said blade portion is elongated and said positioning arms and said additional positioning arms are spaced longitudinally along said blade portion with respect to each other.

21. A method of terminating at least a pair of cables each of which cables having an inner conductor, an inner dielectric surrounding at least a portion of said inner conductor, a metallic shield surrounding at least a portion of said inner dielectric and an outer insulating jacket surrounding at least a portion of said metallic shield to an electrical connector having a dielectric housing with a mating face, a termination face and a plurality of terminal receiving passages between said mating face and said termination face with a terminal extending through at least a portion of some of said terminal receiving passages and having a ground member at least partially secured within said housing, said ground member including a mating portion generally adjacent said mating face and a ground termination portion generally adjacent said termination face, comprising the steps of:

providing each of said cables with a portion of said outer insulating jacket thereof removed from about said metallic shield so as to expose an exposed portion of said metallic shield;

positioning said cables with respect to a shield management member such that said shield management member separates said exposed metallic shields of each of said cables from said inner dielectric of said cable;

bonding said exposed portions of said metallic shields of said cables to said shield management member; and positioning said shield management member within a receptacle formed by a shield terminating portion of said ground termination portion such that said shield management member is electrically coupled to said shield terminating portion of said ground termination portion.

22. The method of claim 21 wherein said exposed portions of said metallic shields of said cables are bonded to said shield management member such that said exposed portions extend about at least a half of the circumference of each of said cables.

23. The method of claim 21 wherein said metallic shield is bonded to one side of said shield management member and said inner dielectric of said cable is disposed adjacent an opposite side of said shield management member.

24. The method of claim 21 including forming said shield terminating member by forming a pair of positioning arms at opposite edges of a blade portion of said ground termination portion to thereby define a generally U-shaped receptacle, and wherein said shield management member is positioned in said receptacle between said pair of positioning arms.

25. The method of claim 24 wherein said shield management member is a generally U-shaped component sized for nesting within said receptacle defined by said blade portion and said positioning arms extending therefrom.

26. The method of claim 25 wherein said U-shaped shield management member includes a pair of leg portions joined by a bight portion, and wherein said shield management member is nested in said receptacle with said leg portions juxtaposed inside said positioning arms and said bight portion juxtaposed against said blade portion of said ground termination portion.

27. The method of claim 26 wherein said U-shaped shield management member includes a pair of leg portions joined by a bight portion, and wherein said shield management is nested in said receptacle with said leg portions juxtaposed inside said positioning arms and said bight portion spaced from said blade portion of said ground termination portion.

28. The method of claim 21 including the step of bonding said shield management member to said shield terminating member.

29. The method of claim 21 wherein said exposed portion of said metallic shield is spread away from said inner dielectric prior to said exposed portion of said metallic shield being bonded to said shield management member.

30. The method of claim 21 wherein said exposed portion of said metallic shield is bonded to said shield management member by soldering said exposed portion of said metallic shield to said shield management member.

31. The method of claim 22 including at least one additional cable to be terminated to said ground termination portion, said additional cable including an additional inner conductor, an additional inner dielectric surrounding at least a portion of said additional inner conductor, an additional metallic shield surrounding at least a portion of said additional inner dielectric and an additional outer insulating jacket surrounding at least a portion of said additional metallic shield, a portion of said additional outer jacket being removed to expose an additional exposed portion of said additional metallic shield and said method further including the steps of positioning said additional cable with respect to an additional conductive shield management member such that said additional shield management member separates said additional metallic shield from said additional inner dielectric of said additional cable, bonding said additional metallic shield to said additional shield management member such that said additional shield management member shields said additional inner dielectric from heat generated when said additional metallic shield is being bonded to said additional shield management member and positioning said additional shield management member within an additional receptacle formed by an additional shield terminating portion on a side of said ground termination portion opposite to said shield terminating portion such that said additional shield management member is electrically coupled to said additional shield terminating portion of said ground termination portion.

32. The method of claim 31 wherein said shield terminating portion has a pair of positioning arms at opposite edges of said ground termination portion defining said receptacle and said additional shield terminating portion has a pair of additional positioning arms at opposite edges of said ground termination portion defining said additional receptacle on said opposite side of said ground termination portion.

33. The method of claim 32 wherein said ground termination portion includes an elongated ground plate and said positioning arms and said additional positioning arms are spaced longitudinally along said ground plate with respect to each other.

* * * * *